US005826985A

United States Patent [19]

Goodman et al.

[11] Patent Number: 5,826,985

[45] Date of Patent: Oct. 27, 1998

[54] CHILD-RESISTANT TEAR-OPEN SYNTHETIC RESIN BAG

[75] Inventors: Frank C. Goodman, Smyrna, Ga.; Robert T. Seeley, Brookfield Center; Robert J. Dempsey, Trumbull, both of Conn.

[73] Assignee: Olin Corporation, Cheshire, Conn.

[21] Appl. No.: 500,421

[22] Filed: Jul. 10, 1995

[51] Int. Cl.[6] ..... B65D 27/36

[52] U.S. Cl. ..... 383/200

[58] Field of Search ..... 383/200

[56] References Cited

U.S. PATENT DOCUMENTS

| | | | |
|---|---|---|---|
| 2,772,823 | 12/1956 | Plamann . | |
| 3,054,551 | 9/1962 | Holbrook et al. . | |
| 3,057,539 | 10/1962 | Leary, Jr. . | |
| 3,084,793 | 4/1963 | Pitman . | |
| 3,291,377 | 12/1966 | Eggen . | |
| 3,373,926 | 3/1968 | Voigtman, Sr. . | |
| 3,545,161 | 12/1970 | Hoshino et al. . | |
| 3,593,483 | 7/1971 | Tracy . | |
| 3,648,922 | 3/1972 | Gebo . | |
| 3,650,461 | 3/1972 | Hutcheson | 383/200 |
| 3,809,220 | 5/1974 | Arcudi | 383/200 X |
| 3,834,113 | 9/1974 | Howe et al. . | |
| 4,332,327 | 6/1982 | Frohwerk et al. | 383/200 |
| 4,579,250 | 4/1986 | Fuss et al. . | |
| 4,629,071 | 12/1986 | Tani . | |
| 4,650,079 | 3/1987 | Tani . | |
| 4,696,404 | 9/1987 | Corella | 383/200 |
| 5,046,300 | 9/1991 | Custer et al. . | |
| 5,116,140 | 5/1992 | Hirashima et al. . | |
| 5,175,011 | 12/1992 | Courvoisier et al. | 383/200 X |

FOREIGN PATENT DOCUMENTS

| | | | |
|---|---|---|---|
| 6122471 | 5/1994 | Japan | 383/200 |

*Primary Examiner*—Jes F. Pascua

*Attorney, Agent, or Firm*—William A. Simons; Wiggin & Dana

[57] ABSTRACT

A tear-open bag is made of non-tearable synthetic resin and comprises a front side and back side formed from a single web of synthetic resin. The sides of the web are heat sealed together to form an end-to-end seam in the bag. The ends of the bag are heat sealed together, thereby forming a completely moisture resistant heat-sealed bag. One end closure of the bag is provided with a tear-propagating slit which can be readily manipulated by an adult to tear off a corner of the bag and thereby form a pour spout for dispensing the contents of the bag in a controlled manner. The slit is not readily or easily used by a child to open the bag, thereby rendering the bag child-resistant.

2 Claims, 2 Drawing Sheets

CHILD-RESISTANT TEAR-OPEN SYNTHETIC RESIN BAG

BACKGROUND OF THE INVENTION

1. Field of the Invention

The present invention relates to a specific tear-open bag. The bag construction includes a non-tearable material having a specific tear structure which enables one corner of the bag to be easily torn therefrom to create a dispensing opening in the bag. The tear structure is configured so as to limit the ability of a child to open the bag.

2. Brief Description of the Art

Numerous different tear-open bag constructions made of synthetic resins have been developed. One particular tear-open bag construction has been employed to contain chlorine-based swimming pool chemicals (e.g., calcium hypochlorite). This bag or package construction is made of a web of non-tearable chlorine-stable synthetic resin. That web is formed into a front side and back side of the bag by heat-sealing the two side ends of the web together to form a seam up the middle of the back side, while simultaneously forming the side edges of the bag by soft sealing or creasing the web. The resulting tube-like construction is then cross-heat sealed at one end. The desired chemical product is then poured in the partially sealed bag and then heat sealed at the other end.

While this package for swimming pool chemicals is child resistant, it is not readily opened even by adults, since it requires either scissors or some other sharp object to open it. It would be desirable to simplify opening the package, while retaining the child resistant feature. The present invention is a solution for this need.

BRIEF SUMMARY OF THE INVENTION

This invention relates to a pool chemical, or other flowable material, container bag which is made of a non-tearable material and has at least one planar heat sealed end closure. The planar heat sealed end closure contains a localized tear-propagating slit that is contained wholly within the heat sealed closure. The slit is elongated in a direction that is oblique relative to a corner of the bag so that the corner can be readily torn off of the bag to form a pouring spout in the bag. The slit is also separated from the free end of the heat sealed end closure so that a child handling the bag cannot easily initiate tearing off of the bag corner.

The bag may be formed from a composite web of non-tearable synthetic resins. Opposite edges of the composite web can be heat sealed together to form a tube with an end-to-end seam. A first end of the tube can then heat sealed together so as to form an open-ended tube which may be readily filled with the flowable material. After filling, the opposite end of the tube can be sealed, thereby forming a completely moisture-resistant heat-sealed bag. One end of the tube is provided with the restricted tear-propagating slit of this invention which facilitates subsequent opening of the sealed bag.

It is, therefore, an object of this invention to provide a bag for containing a flowable material, which bag is made of non-tearable synthetic resin material and is provided with a child-resistant tear-open end.

It is a further object of this invention to provide a bag of the character described wherein the bag has a first planar heat-sealed closure at one end thereof, and which closure contains a manual, but child-resistant, tear-open structure.

It is an additional object of this invention to provide a tear-open bag of the character described wherein the manually tear-open feature includes a slit formed in the first closure end of the bag.

It is yet another object of this invention to provide a tear-open bag of the character described wherein the slit is contained completely within the first closure end of the bag and is disposed at an acute angle relative to a corner formed in the first closure end of the bag.

These and other objects and advantages of the invention will become more readily apparent from the following detailed description of an embodiment of the invention when considered in conjunction with the accompanying drawings.

DESCRIPTION OF THE PREFERRED EMBODIMENTS

The tear-open bags of the present invention are preferably made from a large web of material comprising one or more sheets of synthetic resins laminated, adhesively joined, or extruded together. Any conventional synthetic resins may be used alone or in combination provided the resulting sheets are not tearable. The term "non-tearable synthetic resin material" means that the material may not be torn manually by an average adult without the said of scissors or some sharp object or by having a tear-propagating slit therein or the like. The preferred class of non-tearable synthetic resins are those that are chlorine-stable (i.e., resistant to attack by chlorine). The preferred non-tearable synthetic resin web is preferably from about 3 to 10 mils thick. One of the most preferred non-tearable synthetic resin is a combination of an inner SURLYN 1652 polyethylene polymer available from DuPont and outer VALERON ethene homopolymer (polyethylene) (C.A.S. 9002-88-44) which are either cross-laminated, adhesively joined, or extruded together. One particularly most preferred embodiment employs this SURLYN resin as the inside layer and the VALERON resin as the outside layer and they are cross-laminated together where the machine direction on one resin tow is perpendicular to the machine direction of the other.

In this embodiment, the VALERON layer is formed from two webs of VALERON polyethylene resin adhesively joined together to form a 3 mil total web. That VALERON web is then adhesively affixed to the SURLYN layer (most preferably about a 1.5 mil layer).

The SURLYN material is chosen for its heat-sealability. The VALERON material is chosen for its tear strength properties. Both resins are chlorine-stable.

Preferably, the synthetic resin web has the following properties:

| | |
|---|---|
| Minimum Caliper: | 4.75 mils. |
| Min. Seal Strength: | 8 lbs. per inch |
| Izod Impact Strength: | from 5.7 to 14.6 ft-lb. per inch |
| Minimum Tensile: | |
| Machine Direction: | 20 lbs. at break |
| Cross-Machine Direction: | 22 lbs. at break |
| Minimum Tear: | |
| Machine Direction: | 700 grams |
| Cross-Machine Direction: | 700 grams |

This non-tearable synthetic resin web is preferably printed while it is in the web-form and before the bag-forming steps. Any suitable printing process may be used to print on this web.

Figure 1:
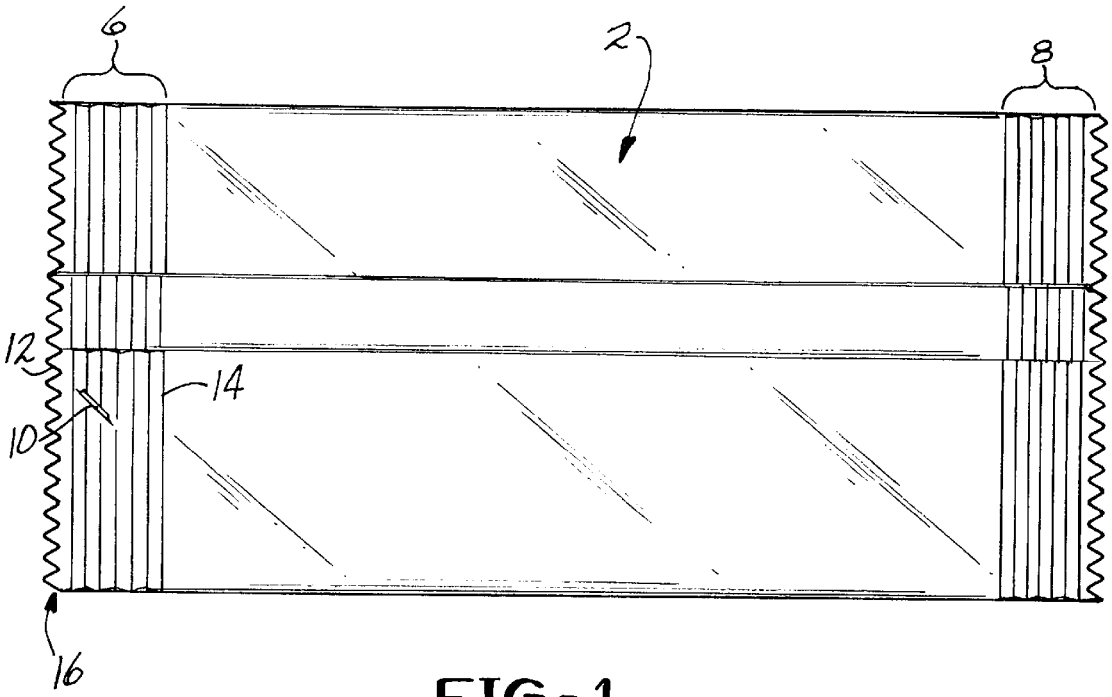
FIG. 1 is a plan view of a preferred embodiment of a child-resistant tear-open bag formed in accordance with this invention.
Figure 2:
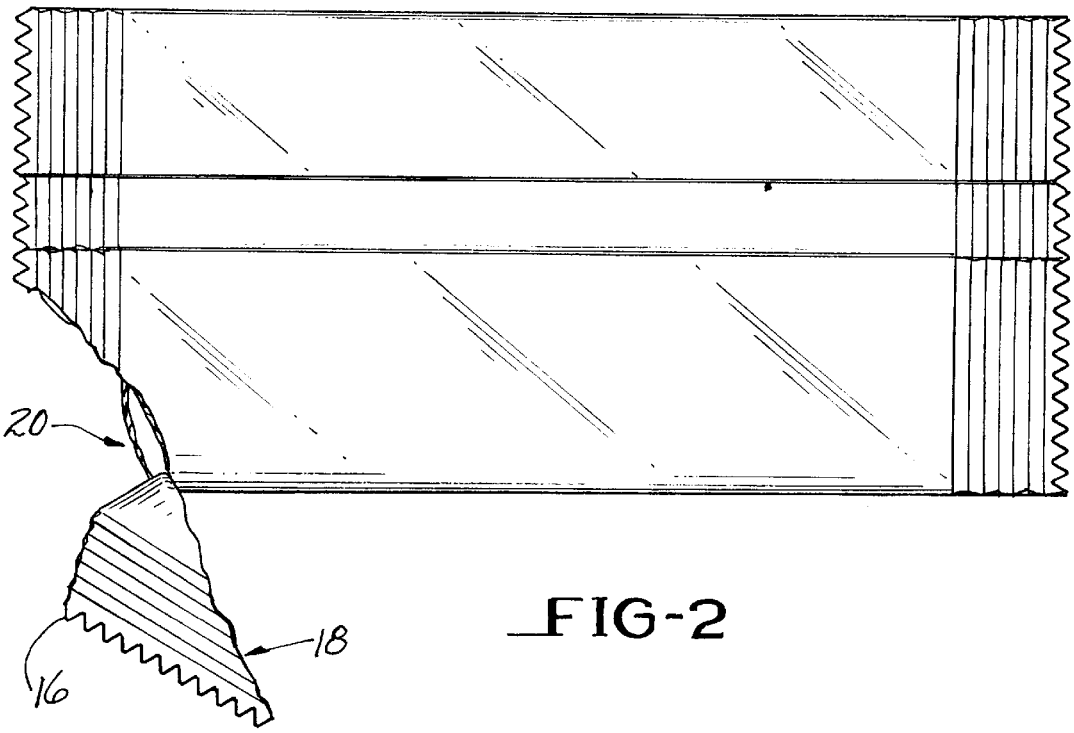
FIG. 2 is an plan view similar to FIG. 1, but showing the corner of the bag, torn open so as to form a material pour spout in the bag.

Referring now to FIGS. 1 and 2, a preferred embodiment of a flowable material package formed in accordance with this invention is illustrated. The bag is denoted generally by the numeral 2, and includes a longitudinal heat seal seam 4 which extends between opposite ends of the bag 2. The opposite ends of the bag 2 are closed with planar longitudinally expanded heat seals 6 and 8. One of the end heat seals in this case the heat seal 6, is provided with a slit 10 which extends completely through the heat seal 6 in the through plane direction. The slit 10 is contained completely within the heat seal 6 and does not extend through the free edge 12 of the bag 2, or through the inner edge 14 of the heat seal 6. The slit 10 is elongated in a direction which is oblique with respect to the corner 16 of the bag 2, and is positioned on the heat seal 6 so as to ensure that a tear 18 in the bag 2 will extend from the slit 10 through a non-heat sealed portion 20 of the bag 2, as shown in FIG. 2, so as to form a pour spout for dispensing material from the bag 2. The fact that the slit 10 does not extend through the free end 12 of the bag 2 renders the opening of the bag 2 by a chile, either intentionally or accidentally, highly unlikely. The slit 10, however, simplifies the opening of the bag 2 by an adult. Preferably, the oblique-directed slit is angled from 30° to 60° from the top edge 12 of the bag.

Figure 3:
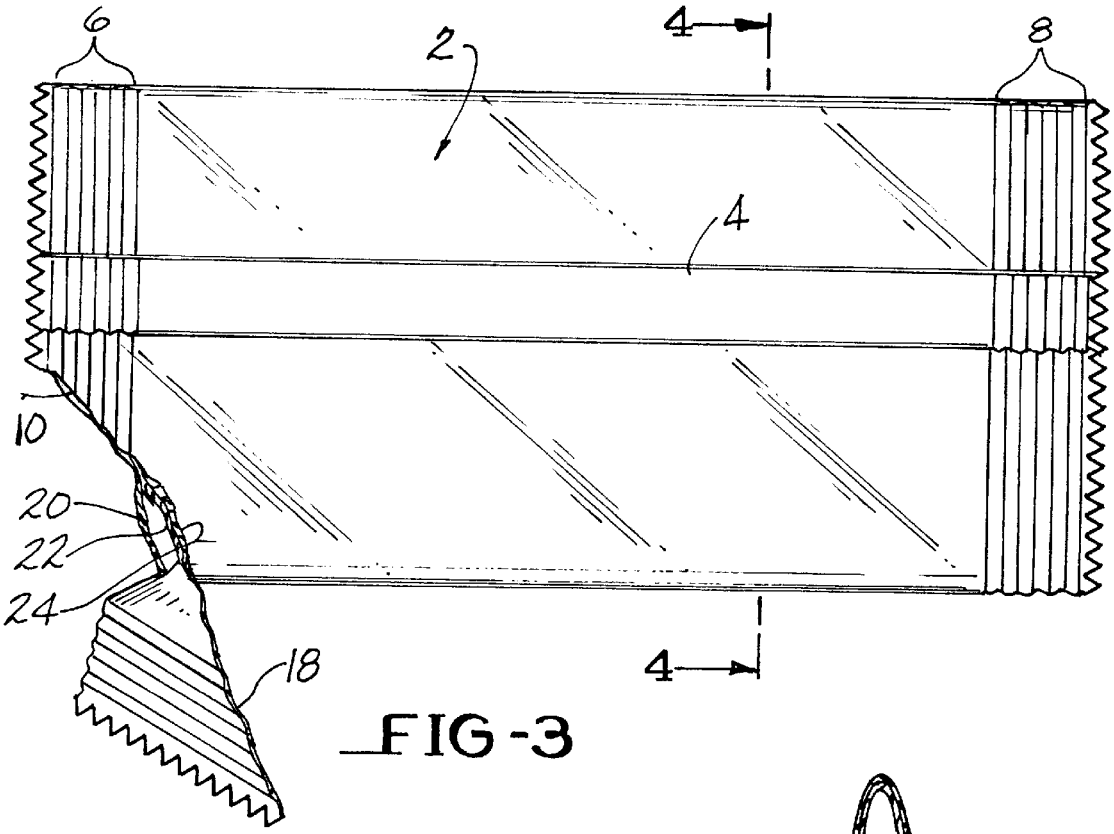
FIG. 3 is a plan view similar to FIG. 2, but showing the corner of the bag, torn open so as to form a material pour spout in the bag, is made from two layers of synthetic resin.
Figure 4:
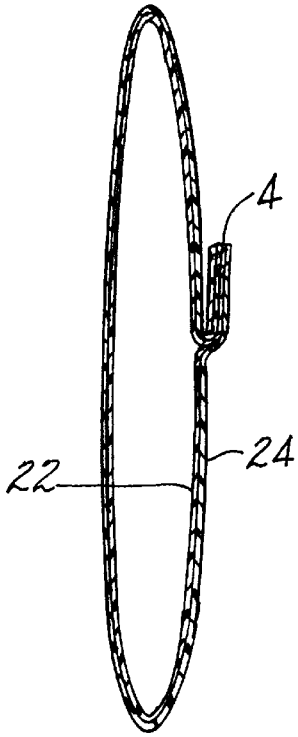
FIG. 4 is a cross-sectional view at line 4—4 of FIG. 3 which shows the two synthetic layer construction for the bag.

Another preferred embodiment is shown in FIGS. 3 and 4. This embodiment involves the a SURLYN 1652 polyethylene polymer as an inside layer (22) and VALERON ethene homopolymer (polyethylene) as the outside layer (24) of the tear-out bag 2 which, like the bag 2 in FIGS. 1 and 2, is closed with plan longitudinally expanded heat seals 6 and 8 and similarly has a pour spout for dispensing material from bag 2 by making the same tear 18 through heat seal 6 and non-heat sealed portion 20.

The desired chemical product, for example, calcium hypochlorite granules, dichloroisocyanuric acid granules or trichloroisocyanuric acid granules, or the like is then filled into the partly heat sealed bag. After filling, the other end of the tube is heat sealed and the ends are cut lengthwise to form the heat-sealed bag.

It will be readily appreciated that the resulting heat-sealed bag is difficult for a child to open, but is easy for an adult to open and use. The adult user only has to manually tear the heat-sealed end closure at the tear-propagating slit. This is the only way the bag can be easily torn open. The torn corner provides a convenient material guiding pour spout from which the contents of the bag may be accurately dispensed.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A tear-open bag for containing a flowable material, said bag being formed with a non-tearable, heat-sealable chlorine-stable synthetic resin, said bag comprising opposite end portions at least one of which is closed by means of an expanded planar heat seal joint, said bag being formed with angled comers at opposite sides of said heat seal joint, and an elongated tear-propagating slit extending through said heat seal joint and not extending to the edges of the bag, said slit being wholly contained within said heat seal joint, and said slit being oriented relative to one of said comers so as to be operable, when manually stressed, to propagate a tear line in the bag which is oblique relative to said one corner so that said one corner can be manually torn away from the remainder of the bag and thereby form a pouring spout in the bag.

2. The tear-open bag of claim 1 wherein the chlorine-stable synthetic resin is a combination of more than one layer of polyethylene resin.

* * * * *